US010125540B2

(12) United States Patent
Femont et al.

(10) Patent No.: US 10,125,540 B2
(45) Date of Patent: Nov. 13, 2018

(54) SECTIONAL DOOR WITH LIFTING MECHANISM

(71) Applicant: GMP NV, Schoten (BE)

(72) Inventors: Frank Femont, Schilde (BE); Oliver Femont, Schilde (BE); Anthony Femont, Schilde (BE)

(73) Assignee: GMP NV, Schoten (BE)

( * ) Notice: Subject to any disclaimer, the term of this patent is extended or adjusted under 35 U.S.C. 154(b) by 0 days.

(21) Appl. No.: 15/115,352

(22) PCT Filed: Jan. 29, 2015

(86) PCT No.: PCT/EP2015/051864
§ 371 (c)(1),
(2) Date: Jul. 29, 2016

(87) PCT Pub. No.: WO2015/114066
PCT Pub. Date: Aug. 6, 2015

(65) Prior Publication Data

US 2017/0009517 A1 Jan. 12, 2017

(30) Foreign Application Priority Data

Jan. 29, 2014 (BE) ..... 2014/0051

(51) Int. Cl.
*E05D 15/26* (2006.01)
*E06B 9/06* (2006.01)
(Continued)

(52) U.S. Cl.
CPC ..... *E06B 9/0676* (2013.01); *E06B 5/10* (2013.01); *E06B 7/2318* (2013.01); *E06B 9/0638* (2013.01)

(58) Field of Classification Search
CPC ..... E06B 9/0676; E06B 7/2318; E06B 5/10; E06B 9/0638
(Continued)

(56) References Cited

U.S. PATENT DOCUMENTS 3,763,594 A * 10/1973 Banzei ..... E05D 15/165 49/103
4,374,537 A * 2/1983 Lindbergh ..... E05D 13/14 160/189
(Continued)

FOREIGN PATENT DOCUMENTS

CA 2938224 A1 * 8/2015 ..... E06B 9/0638
DE 202008006088 U1 6/2009
(Continued)

OTHER PUBLICATIONS

Belgium Search Report for corresponding Belgium Application No. 201400051, dated Sep. 19, 2014.
(Continued)

*Primary Examiner* — Jerry E Redman
(74) *Attorney, Agent, or Firm* — Workman Nydegger

(57) ABSTRACT

A sectional door comprising a plurality of panels which can be stacked on top of each other in a stacked state, and next to each other in a stored state; a drive system with a cable or chain for moving the bottom panel in the height direction; upright rails for guiding the panels in the stacked state; guides (or guide assembly) for guiding the panels in the stored state comprising a worm wheel with helical groove for guiding the panels in the storage room; wherein the drive system further comprises a lifting mechanism for removing the upper panel from the stack, and for transferring it to the storage zone.

11 Claims, 7 Drawing Sheets

(51) Int. Cl.
*E06B 5/10* (2006.01)
*E06B 7/23* (2006.01)

(58) Field of Classification Search
USPC ..... 49/125, 126, 127, 128, 129, 464
See application file for complete search history.

(56) References Cited

U.S. PATENT DOCUMENTS 4,379,478 A * 4/1983 Lichy ..... E06B 3/927 160/229.1
4,460,030 A * 7/1984 Tsunemura ..... E05D 15/242 160/35
4,538,661 A * 9/1985 Henry ..... E06B 9/0638 160/189
4,662,420 A * 5/1987 Hirao ..... E06B 9/0638 160/133
4,787,119 A * 11/1988 Furuya ..... E04B 2/827 16/102
5,065,806 A * 11/1991 Kondoh ..... E06B 9/0676 160/36
5,072,766 A * 12/1991 Kondoh ..... E06B 9/0676 160/32
5,133,398 A * 7/1992 Yang ..... E06B 9/0676 160/202
5,172,742 A * 12/1992 Iwasaki ..... E06B 9/0676 160/32
5,316,065 A * 5/1994 Alligood ..... E06B 9/0638 160/170
5,685,355 A * 11/1997 Cook ..... E06B 9/0676 160/201
6,339,905 B1 * 1/2002 Craig ..... E06B 9/0638 160/33
6,651,724 B1 * 11/2003 Cittadini ..... E06B 9/0669 160/207
7,681,620 B2 * 3/2010 Padan ..... E06B 3/927 160/169
7,950,438 B2 * 5/2011 Albert ..... E06B 3/927 160/201
8,327,908 B2 * 12/2012 Godovalov ..... E06B 9/0638 160/188
8,468,751 B2 * 6/2013 Williams ..... E04B 2/827 160/201
8,869,450 B2 * 10/2014 Balay ..... E06B 3/483 160/33
9,249,610 B2 * 2/2016 Reus ..... E04H 4/082
2005/0126721 A1 * 6/2005 Fan ..... E05D 15/165 160/201
2010/0072868 A1 * 3/2010 Deem ..... E06B 3/925 312/319.7
2012/0047804 A1 * 3/2012 Talboys ..... E05D 15/20 49/25
2012/0233924 A1 * 9/2012 Kitterman ..... E05F 17/00 49/77.1
2016/0130865 A1 * 5/2016 De Muelenaere ..... E04F 10/10 160/113

FOREIGN PATENT DOCUMENTS

DE 202012010711 U1 11/2013
EP 1234946 A2 8/2002
EP 2113627 A2 11/2009
GB 2244304 A 11/1991
JP H07310483 A 11/1995
WO 9609457 A1 3/1996
WO 2012158147 A1 11/2012

OTHER PUBLICATIONS

International Search Report for corresponding International PCT Application No. PCT/EP2015/051864, dated Mar. 30, 2015.
Philippines Office Action from PH Application No. PH 1/2016/501479, dated Jun. 28, 2018.

* cited by examiner

SECTIONAL DOOR WITH LIFTING MECHANISM

FIELD OF THE INVENTION

The present invention is situated in the domain of access ports, more in particular to sectional doors or gates, and specifically to sectional doors or gates with panels that are not connected to each other two by two.

BACKGROUND OF THE INVENTION

Access ports are generally known, and typically serve to provide access to an opening of a building, e.g. to a garage or a barn or a workshop or a warehouse. Where about hundred years ago typically wooden gates were used, which were hingedly mounted by means of hinges for allowing the gate to turn inwardly or outwardly with respect to an upright wall, nowadays typically tilt (up) doors or sectional (overhead) doors are used. Tilt doors are typically tilted as a single entity from a vertical plane (door closed) to a horizontal plane (door open) parallel to the ceiling, but have the disadvantage that they might hit objects (such as e.g. a car) located close to the door, during the tilting operation. This problem is greatly reduced by sectional doors, which generally contain multiple panels of relatively small height, which are pivotally connected to each other, two by two. Such doors can e.g. be opened by rolling up the panels on a shaft or reel, for example in a manner similar to a roller shutter. Such doors may even have doors and windows, which are rolled up along with the entire door.

On the other hand, sectional doors having a plurality of panels which are not interconnected with each other, also exist. Such a sectional door is described for example in EP1234946, and is replicated in FIG. 1 and FIG. 2 of the present invention. FIG. 1 shows the sectional door in stacked state (door closed), also referred to as "closed state". FIG. 2 shows two panels in the upright rails, and three panels in inclined storage guides (door is half open). The patent document JPH07310483 describes a very similar sectional door. In both cases, the door is opened or closed by an upward or downward movement of the bottom panel by means of winding or unwinding a steel cable attached to the bottom panel. As a result, the other panels, which rest on the bottom panel, are also moved upward or downward. During the upward movement the top panel is forced into storage rails, where the panels are stored next to each other and against each other. During the downward movement panels are lowered out of the storage rails, one by one. A disadvantage of these sectional doors is that the panels laterally rub against each other, which can cause scratches, and may sometimes even block the mechanism.

SUMMARY OF THE INVENTION

It is an aim of embodiments of the present invention to provide a good sectional door.

In a first aspect, the present invention relates to a sectional door comprising a plurality of panels having a shape such that they can be stacked on top of each other in a stacked state of the sectional door, and next to each other in a stored state, of the sectional door; a drive system with a cable, chain or belt attached to the bottom panel, adapted for moving the bottom panel and the panels resting thereon in the height direction; upright rails for guiding the stacked panels; means for guiding the panels in a storage zone; wherein the drive system further comprises a lifting mechanism to each time remove the upper panel from the stack of panels stacked on top of each other by accelerating it, and by subsequently transferring said upper panel to the means for guiding the panels in the storage zone. The means for guiding the panels in a storage zone comprises a worm wheel having a helical groove for guiding the panels in the storage zone, by supporting a lateral extension of the panels in the helical groove.

By making use of a helical groove for storing the panels in the storage zone, the panels can be moved in the storage zone without requiring the panels to touch each other laterally. As a result, scratches and other damage is avoided. Additionally, the sectional door will operate more silently. The worm wheel can be so positioned that it supports the panels when they are in the storage zone, or more specifically that it supports a lateral projecting part of the panels.

It is a further advantage of the helical groove of the worm wheel in that the panels are active slid "forwards" or "backwards" upon rotation of the worm gear, i.e., towards or away from the upright surface in which the upright rails are located. In this way, inclined rails can be avoided, so that the storage space can be more compact, and extends less in the height direction. In this way also the use of a spring or the like for pushing the panels out of the storage zone, can be avoided.

It is an advantage of embodiments of the present invention that doors are provided which are particularly well suited as watertight doors. The lifting mechanism helps to avoid wear of components subject to wear or due to influence by water.

An additional advantage of the acceleration of the upper stacked panel is that the releasable coupling (e.g. a recess and a protrusion) between the respective panel and the panel located thereunder, can be separated from each other with increased reliability when being opened, even when some friction or stress occurs between the coupling means (for example when the protrusion was compressed elastically in a narrow groove, in a manner similar to an O-ring pressed into a groove).

Thanks to the lifting mechanism, the panels do not need to be tilted, but they will remain in an upright (vertical) position, both in the stacked state, and in the storage zone. This does not impose additional requirements to the releasable coupling means between the panels, such as e.g. extra clearance and/or roundings and the like.

The lifting mechanism is therefore highly suitable for removing panels having releasable coupling means which are closely connected, e.g. for providing watertight sectional doors capable of withstanding flooding.

The lifting mechanism may comprise a gripper arm for gripping a lateral extension of the highest panel of the stack of panels, and may further comprise a helical groove for moving the gripped panel to the storage zone. It is noted that the term "upper stacked panel" or "highest panel of the stack" is used, and not the "top panel", because each time another panel is the highest of the stack and is gripped during the opening of the sectional door.

The gripper arm may comprise a cylindrical wall section which is provided to carry out a rotational movement, whereby the helical groove is located on the outside of the cylindrical wall section. It is an advantage that the gripper arm can be formed by a cylindrical wall section (also referred to as "wall fraction"), because both the wall fraction and the rotational movement can be implemented in a relatively simple way, with a minimum number of parts.

It is an advantage of such a lifting mechanism that the panel performs a pure vertical translational movement during the acceleration, and only after it has reached the desired height, performs a pure horizontal translational movement in a direction perpendicular to the plane of the upright profiles or rails (away from the plane of the closed door).

It is an advantage that the panels do not need to perform any rotational movement, or tilting movement, because in this way the risk that the upper stacked panel is not released from the underlying panel is minimized, while an optimal (e.g. tight) connection between the two panels is possible in the closed state (e.g. with a lip and groove joint).

The cylindrical wall section may comprise a wheel, adapted for supporting the lateral extension in a displaceable manner. By making use of a wheel (or the like), friction and wear of the lateral extension and of the gripper arm are reduced or avoided, and a smooth operation is obtained. The wheels may be adapted for supporting the protrusions over their entire width.

The lateral projecting part of the panels may further comprise a wheel that fits into the helical groove. In contrast to certain embodiments of the prior art, wherein such a wheel rotates about an axis oriented parallel to the plane in which the door is located when in the closed state, the worm wheel according to embodiments of the present invention moves about an axis which is substantially perpendicular to said plane in which the door is located when in the closed state.

In this way, the displacement of the panels in the storage zone is controlled by rotation of the worm wheel, and at the same time wear of the helical groove and of the panel projection is reduced, and the storage of the panels is achieved in a smooth manner, without the panels rubbing against each other.

The cylindrical wall section and the worm wheel may be connected to each other in such a way that the helical groove forms a continuous transition between the cylindrical wall section and the worm wheel. In this way, it is ensured that the helical groove extends from the gripper arm to the storage zone, and that a single rotational movement will both pick up the upper stacked panel from the stack and will move (e.g. slide) the panels into the storage zone.

Preferably, the worm wheel and the cylindrical wall section are formed as a single entity, but that is not absolutely necessary for the present invention. Preferably, the cylindrical wall section and the worm wheel have the same constant outer diameter, but also that is not absolutely required.

The helical groove of the worm wheel can have a larger pitch on the cylindrical wall section than on the rest of the worm wheel. Preferably, the pitch of the helical groove on the cylindrical wall section (which performs the function of gripping arm) is greater than the pitch on the rest of the worm wheel, because in that way the panel which was gripped by the gripper arm is rapidly moved into a direction away from the plane of the upright rails, so as to create a "safe distance" between the panels which are already present in the storage zone (sliding or shifting gently), and the panel which is rapidly removed from the stack. In this way, the risk of damage or scratches due to e.g. swinging as a result of the acceleration is reduced or negligible.

A lower panel may have at its top side a protrusion, and an upper panel may have on its bottom side a recess of a complementary shape, or vice versa.

The protrusion and the recess can for example be an elongated lip and groove. In this way, the lip and the groove can engage in or with one another when the panels are stacked on top of each other. In this way, it is prevented that the panels (when in the stacked state of the sectional door) can tilt about their lateral extension. In other words, in this way, a releasable connection is made between abutting panels, particularly between a top side of a lower panel, and a bottom side of an abutting upper panel.

Suitable shapes of recesses and matching protrusions are known in the prior art, e.g. a concave recess and a convex bulge, or a lip and a groove, and the like. It is an advantage of the present invention that the shapes can be chosen such that they fit against and/or into each other, by a purely vertical movement relative to each other, without tilting. This allows the use of smaller tolerances between the releasable connection means.

By making use of suitable materials and shapes, e.g. a rubber-like material, a water-tight seal can be guaranteed between the abutting panels. Obviously, such a seal is also resistant to rain, snow and the like.

By providing a lip and groove connection in accordance with embodiments of the present inventions, the sectional door can withstand a water pressure exerted on either side. The door can thus be mounted on the outside, but also on the inside of a building.

The sectional door may further comprise inflatable rubber seals located in the upright rails for sealing the sectional door in a water-tight manner when in the closed state. Thanks to the inflatable rubber seals, the sectional door can be sealed in a watertight manner relative to the rails. Such rubber seals can be inflated (i.e. expanded under air pressure) with the aid of e.g. an electric compressor or pump. The compressor or pump may or may not be part of the sectional door. Optionally also a pressure vessel can be foreseen, in which air under a predetermined pressure can be stored to bring the seals under pressure even when the electricity supply is interrupted. Alternatively or additionally batteries may also be provided to activate the compressor or pump in case of a power supply failure.

The panels can be mutually sealed watertight for example by making use of a rubber strip or any kind of hollow or solid elastic shape which is pressed against the surface of the underlying and/or overlying panel.

The panels may comprise a profile of extruded aluminum and/or a fiber-reinforced plastic and/or a machined plastic. The processed plastic may be a stitched plastic. Such panels offer the advantage that they are both mechanically strong, in particular have a sufficient bending strength to resist external pressure forces, for example a pressure force exerted on the outside of the sectional door by a water column, in the case of a flood, while they have a relatively small weight. In this way, the cost of materials, as well as the installation and maintenance costs can be limited.

Preferably, hollow profiles are used, which, if desired, can be fully or partially filled with an insulating foam material, e.g. Polyurethane, for thermal insulation and/or acoustic insulation, and possibly even for additional mechanical reinforcement.

The present invention also relates to a worm wheel for a sectional door, for use in a sectional door as described above, the worm wheel comprising a first segment having a cylindrical wall fraction, and a second segment having a cylindrical wall, and a continuous helical groove extending over the first and the second segment.

The pitch of the helical groove in the region of the first segment can be greater than the pitch of the helical groove in the region of the second segment. In an example the (maximum or mean) pitch of the first segment is at least 50% greater than the (maximum or mean) pitch of the second segment (i.e. at least a factor 1.5 greater). In another example, it may be at least a factor of 2 greater.

The present invention also relates to a kit of parts comprising two worm wheels as described above, each with a helical groove, at least two panels, wherein each panel has at least two lateral protrusions with a wheel that fits into the helical groove, and wherein the pitch of the helical groove over the entire worm wheel is greater than, or equal to the thickness (d) of the panels. In an embodiment of the present invention, the worm wheel can, in its last movement when closing the sectional door, press the panels down, for example by means of an additional arm which is pressed on the top panel by the worm wheel. Alternatively the top panel can be pressed by another means than by the worm wheel (e.g. mechanically). The other means can for example make use of compressed air. In an embodiment of the present invention the bottom panel always remains between the upright rails.

Particular and preferred aspects of the invention are set out in the accompanying independent and dependent claims. Features from the dependent claims may be combined with features of the independent claims and with features of other dependent claims as appropriate and not merely as explicitly set out in the claims.

These and other aspects of the invention will be apparent from and elucidated with reference to the embodiment(s) described hereinafter.

SHORT DESCRIPTION OF THE DRAWINGS

FIG. 9 to FIG. 12 together schematically show how a panel is gripped by a gripper arm, and is accelerated in the vertical direction, and is then stored in a horizontal direction.

Figure 9:
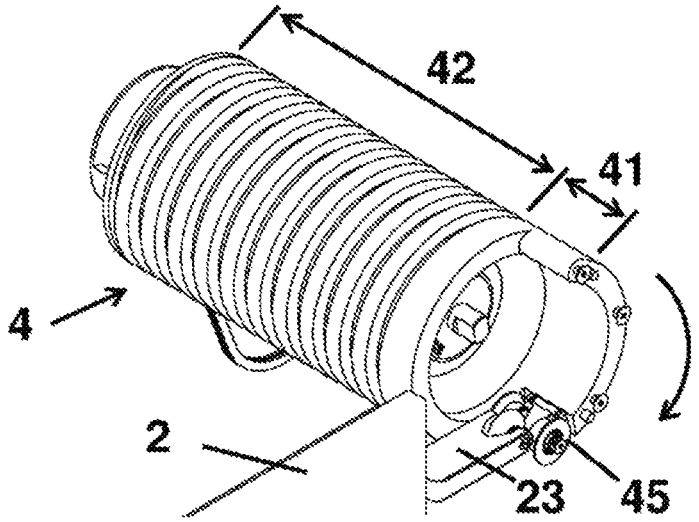

FIG. 9 shows how the gripping arm comes into contact with a lateral extension of a panel.

Figure 10:
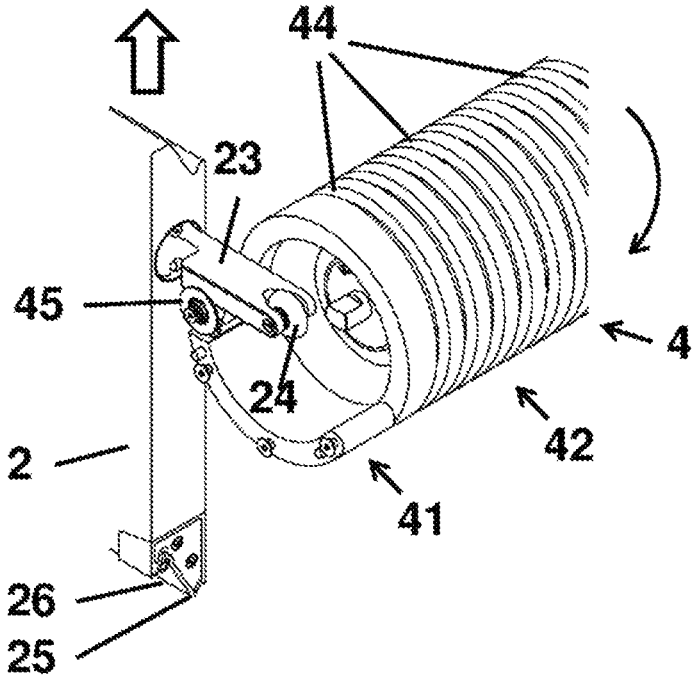

FIG. 10 shows how the panel is picked up in an accelerated manner in a purely upward movement.

Figure 11:
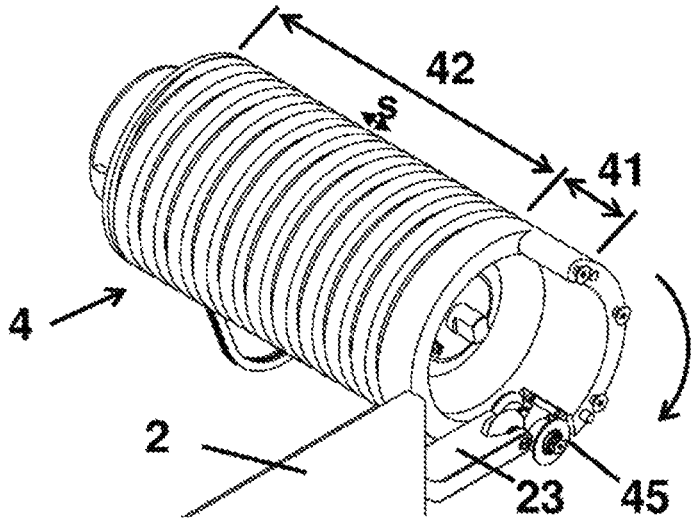

FIG. 11 shows the end of the accelerated upward movement, and the start of the horizontal movement into the storage zone.

Figure 12:
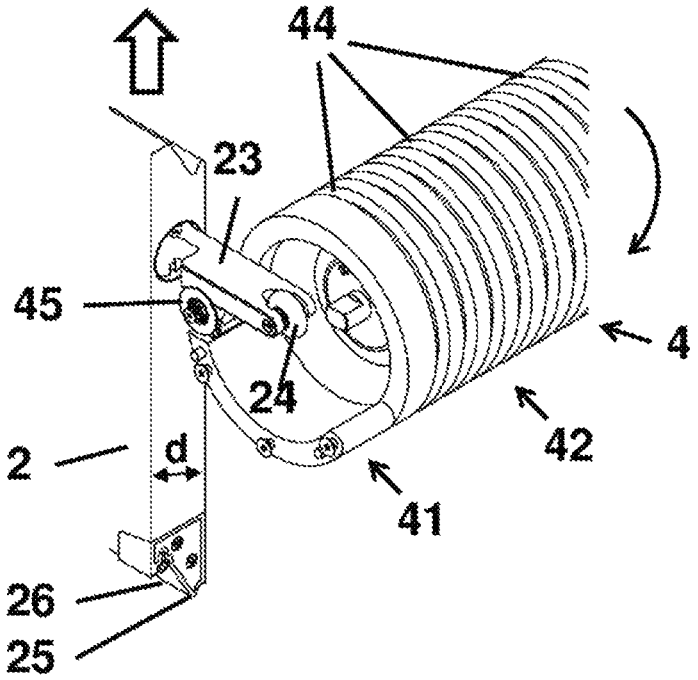

FIG. 12 shows the position which the panel will occupy after multiple turns of the worm wheel (additional panels are not shown for illustrative reasons).

Figure 13:
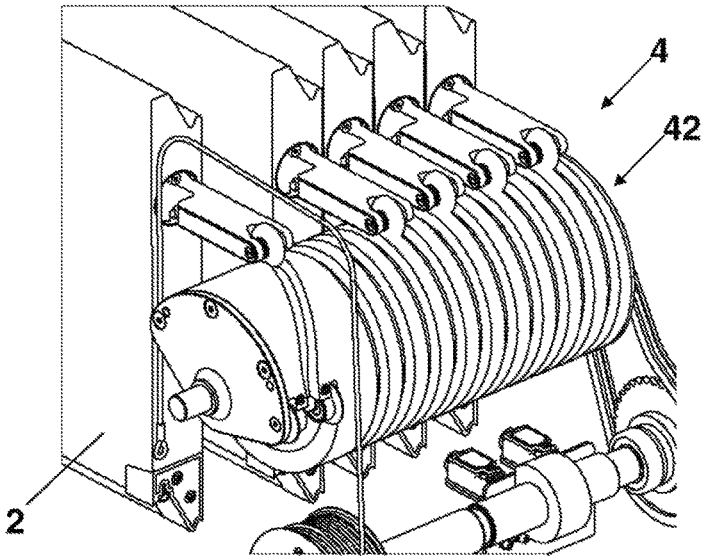

FIG. 13 shows the panels stacked in a side-by-side arrangement on the worm wheel, according to an embodiment of the present invention.

The drawings described are only schematic and are non-limiting. In the drawings, the size of some of the elements may be exaggerated and not drawn on scale for illustrative purposes. The dimensions and the relative dimensions do not correspond to actual reductions to practice of the invention.

Any reference signs in the claims shall not be construed as limiting the scope.

In the different drawings, the same reference signs refer to the same or analogous elements.

DETAILED DESCRIPTION OF EMBODIMENTS OF THE INVENTION

The present invention will be described with respect to particular embodiments and with reference to certain drawings but the invention is not limited thereto but only by the claims.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

Although the present invention is sometimes explained on the basis of one projection (or protrusion) and one gripping arm and one worm wheel, it is clear to the skilled person that there may be multiple projections and/or gripping arms and/or worm wheels.

In the present invention, sometimes reference is made to the "upper panel" or to the "upper stacked panel" or the "highest panel of the stack of panels". This does not necessarily mean the top panel of the door when it is in the closed state, but it means the panel which is at the top of the (full or partial) stack at a given moment, when the door is being opened or being closed. The "bottom panel", however, is always the same panel.

In a first aspect, the present invention relates to a sectional door (also known as sectional gate). The sectional door comprises a plurality of panels having a shape such that they can be stacked on top of each other in a stacked state of the sectional door (door closed), and can be arranged (e.g. stacked, hung) next to each other in a stored state of the sectional door (door open). The sectional door also comprises a drive system with a cable or a chain attached to the bottom panel, adapted to move the bottom panel and the overlying panels in the height direction, e.g. in the vertical direction. Embodiments of the present invention also comprise upright rails for guiding the stacked panels (e.g. vertically), and means for guiding the panels in a storage zone (e.g. horizontally). The drive system includes a lifting mechanism adapted to each time remove the highest panel from the stack of panels stacked on top of each other by accelerating it, and to subsequently transfer said panel to the means for guiding the panels in the storage zone. When opening the sectional door, the panels are thus removed one by one from the stack, which can typically be performed by a combination of two mechanisms: on the one hand, lifting the bottom panel (and therefore also all panels resting thereon) by means of a cable, belt or chain, which is typically rolled up at a constant speed, and on the other hand, the accelerated removal of the highest panel of the partial stack of panels.

The lifting mechanism is typically adapted for gripping the highest panel, for accelerating this panel, and for positioning this panel in a storage zone, where the panels are preferably stored in an upright orientation, and next to each other, without side contact. The panels are preferably separate panels which can be stacked on top of each other (in the stacked state, i.e. door is closed), or can be hung next to each other in the stored state (i.e. door is open), apart from the bottom panel, which always remains between the upright rails. In contrast to classical sectional doors, which are rolled up, the panels of the sectional door according to the present invention are preferably not permanently connected to each other. This has the advantage compared to systems with, for example hinged connections between adjacent panels, that the panels do not need to be wound, but can be stored separately, e.g. next to one another. In this way, the storage is compact, and at the same time side contact between the panels is maximally avoided. Moreover, in this way it is also avoided that connection elements (e.g. elongated hinges) have to be used which are typically subject to wear (for example, can rust when used in a humid environment), and which typically prevent that the panels can be arranged in a compact stack.

When the door is being closed, the lifting mechanism will of course work in reverse, namely as a "lowering mechanism", whereby each time one panel is removed from the storage zone, is lowered in an accelerated manner, and it is then added gently at the top of the partial stack.

According to embodiments of the present invention, the means for guiding the panels in a storage zone comprise a worm wheel having a helical groove for guiding the panels in the storage zone, by supporting a lateral extension of the panels in the helical groove.

Further standard and optional features and possible advantages will be described with reference to the figures, which are illustrative examples of the invention, embodiments of the present invention not being limited thereto.

Figure 1:
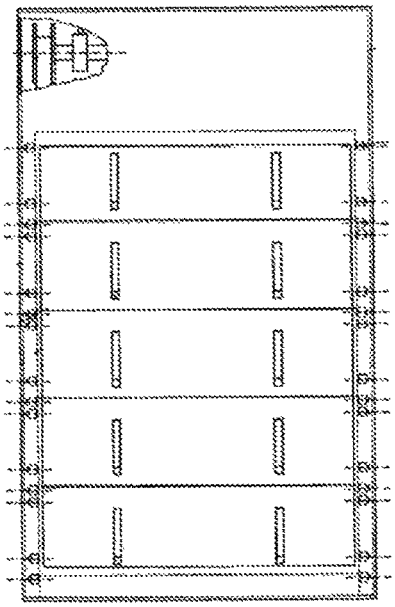
FIG. 1 (prior art)
FIG. 1 shows a sectional door known in the prior art, in front view.
Figure 2:
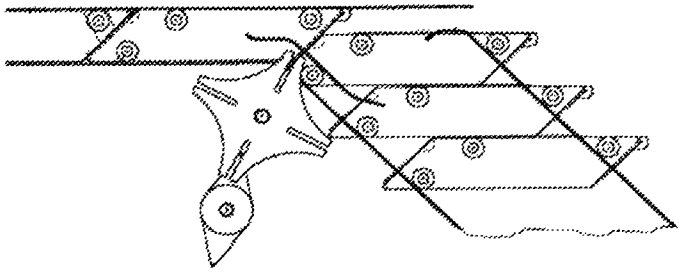
FIG. 2 (prior art)
FIG. 2 shows the lifting mechanism belonging to the sectional door of FIG. 1.
Figure 3:
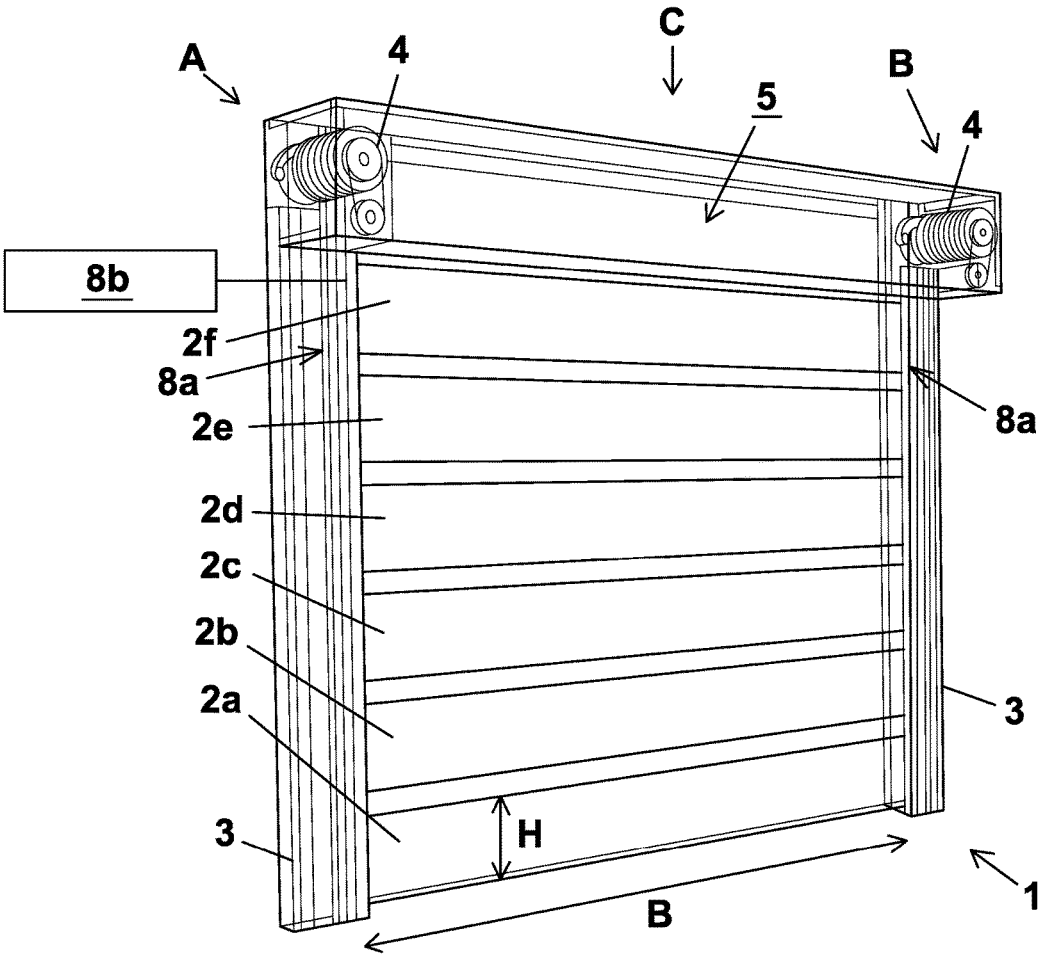
FIG. 3 shows an embodiment of a sectional door according to the present invention in perspective view.

FIG. 3 shows an example of a sectional door 1 according to an embodiment of the present invention, in perspective view. The door is in the stacked state (also referred to herein as "closed state"), whereby six panels 2*a* to 2*f* are stacked on top of each other, but the invention is not limited thereto, and more than six or less than six panels can also be used. In this state, the panels 2 are resting on top of each other. Typically in the closed state, the panels are also pressed and/or blocked at the top, although that is not absolutely required for the present invention. The panels have lateral extensions 23 (not visible in FIG. 3), which are guided in the upright rails 3. The panels can have various dimensions, e.g. a height H of 30 to 60 cm, and a width B of 200 to 400 cm, but the invention is not limited to these values, and other dimensions can also be used. At the top of the sectional door 1 there is a storage zone 5, where the panels 2 are stored next to each other in the open state of the door, as will be explained further.

Although not visible in FIG. 3, the bottom panel 2*a* is connected via a cable 6, for example a steel cable, a belt or a chain with a motor, or the like, by means of which the bottom panel 2*a* and the panels 2*b* to 2*f* resting thereon, can be moved together, up or down. The cable 6 or chain is preferably arranged in the upright rails or profiles 3. Obviously the dimensions of the storage zone 5 are largely determined by the number and the dimensions of the panels 2, which, in turn, depend e.g. on the dimensions of the opening in the building.

Preferably, the storage zone 5 is beam-shaped (as shown in the example). This is possible because the panels 2 in the storage zone perform a horizontal movement, without rubbing against each other. This has as an advantage over for example, the sectional door described in EP1234946, that it requires a lower ceiling height because no inclination is required to push the panels against each other, and with respect to the sectional door of JPH07310483 that no spring is required to push the panels against each other. In practice, the storage zone 5 is preferably closed or covered, e.g. by metal plates or wooden boards, for an aesthetic finishing, and for safety.

Although optional, FIG. 3 also shows inflatable rubber 8*a* seals between the stacked panels 2 and the upright rails 3, so as to provide a watertight sectional door. Such rubber seals 8*a* can be inflated (i.e. expanded under air pressure) with the aid of e.g. an electric compressor 8*b* or pump 8*b*. The compressor 8*b* or pump 8*b* may or may not be part of the sectional door 1. Obviously, in order to be watertight, it also has to be ensured that no water can seep under the bottom panel 21, and between the panels 2*a*-2*f*. This will be further explained below, a.o. when discussion FIG. 5 and FIG. 6. It should be noted that also other sealing means may be used.

Figure 4:
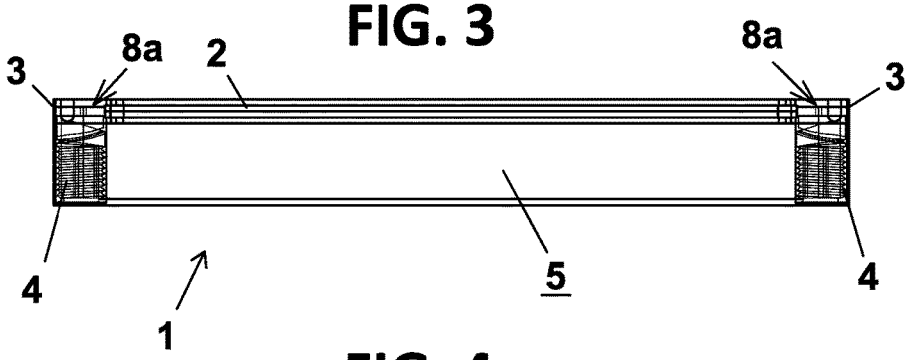
FIG. 4 shows the sectional door of FIG. 3 in top view (viewing direction C).

FIG. 4 shows the sectional door 1 of FIG. 3 in top view (from viewing direction C). The sectional door 1 is in the closed state, wherein the panels 2 are stacked on top of each other. The position of the two worm wheels 4, in the vicinity of each upright rail 3, is also clearly visible in this figure. In the embodiment shown, each worm wheel 4 has its own motor, but that is not absolutely necessary, and the two worm wheels could also be driven by a single motor. The motor may be externally or may be located, for example in the spindle.

Figure 5:
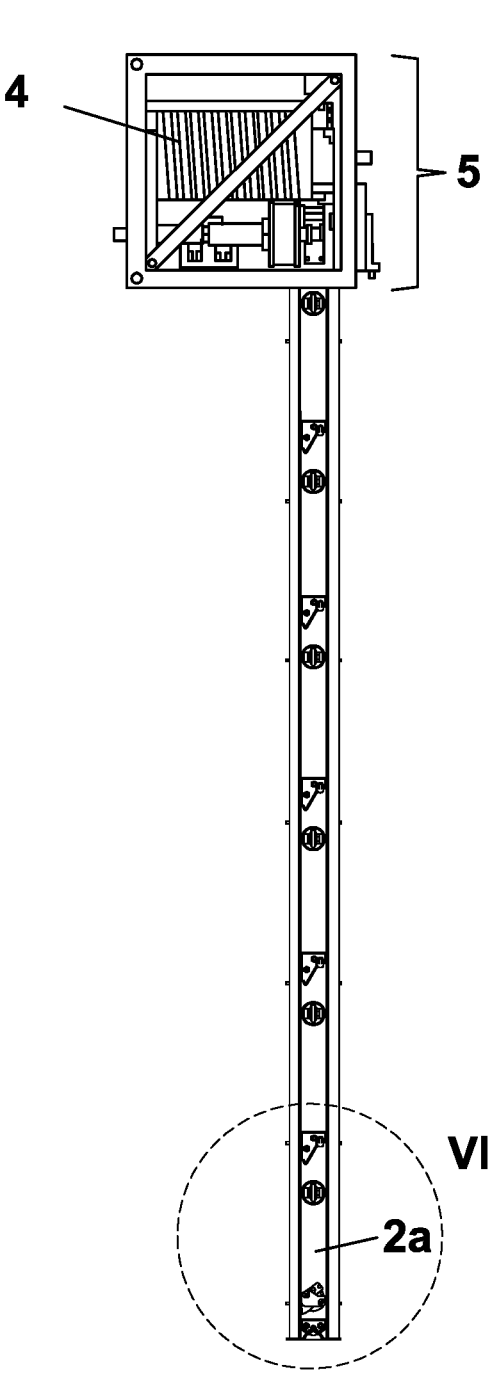
FIG. 5 shows the sectional door of FIG. 3 in side view.

FIG. 5 shows the sectional door 1 of FIG. 3 in side view.

Figure 6:
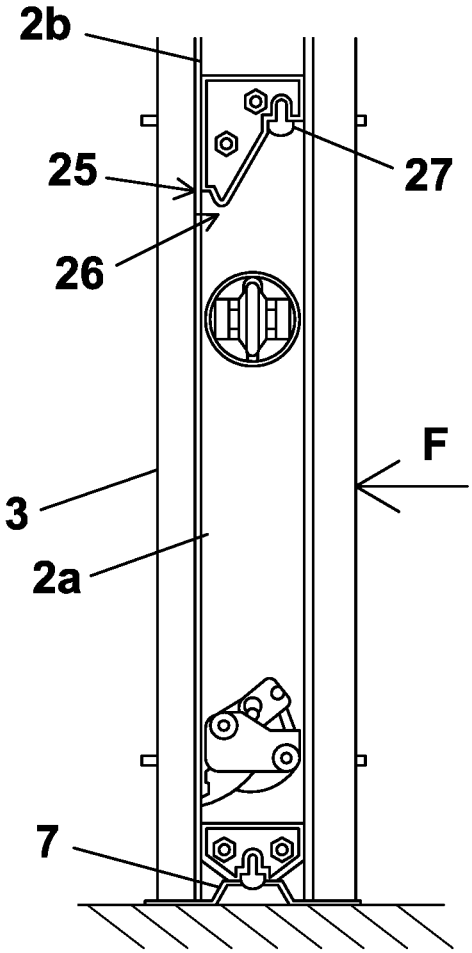
FIG. 6 shows the bottom panel of FIG. 5 in enlarged view.

FIG. 6 shows the bottom panel 21 of FIG. 5 in enlarged view, as well as a portion of the superjacent panel 2*b*. The upright rails 3 are preferably U-profiles. The bottom panel 21 has at an upper side thereof a recess 25, for example a groove for receiving a protrusion 26, e.g. an elongated lip of the superjacent panel 2*b*. There may also be more than one recess 26 and more than one protrusion 25. Various forms of recesses 26 and protrusions 25 are possible, as long as the shape of the recess and the protrusion are substantially complementary, and the panels can be separated from each other without tilting. Together they form a releasable or detachable connection between the adjacent panels. They can also provide additional mechanical strength.

As shown, the upper panel also has a recess for accommodating an elastic, e.g. rubber strip 27, which, for example is pressed against a flat or hollow portion of the upper side of the lower panel. In this way water is prevented from seeping between the panels. Of course it is possible to provide a plurality of such strips, and of course, the strip may be attached to the lower panel instead of the upper panel, and be pressed against a flat or hollow section of a lower side of the upper panel. Thanks to such strip the panels can thus be connected to each other in a watertight manner. The strip is compressed by the weight of the panels, so that no water can seep between the panels.

It is noted that such a recess and protrusion can also be provided between the floor, e.g. the floor of a garage, and the bottom panel 21. A floor profile 7 may be fixed to the bottom for this purpose. The floor profile shown in this example has a trapezium-shaped cross-section, but embodiments of the present invention are not limited thereto. An additional advantage of the floor profile 7 is that it is also prevents that the bottom panel 21 can rotate about an axis passing through its lateral extensions 23, for example when a lateral force is applied to the panel in a direction perpendicular to the plane of the panel stack.

The panels themselves are designed in terms of dimensions, shape and materials such that each panel can withstand the weight of the overlying panels, and optionally also against the lateral pressure from an upright water column having a predetermined height, for example 3.00 m.

However, the invention is not limited to watertight sectional doors, therefore, the elastic strip 27, and the floor profile 7, and the inflatable rubber seal in the upright rails 3, are not essential for the present invention. In the figure, above the floor profile also a fall protection is visible.

Figure 7:
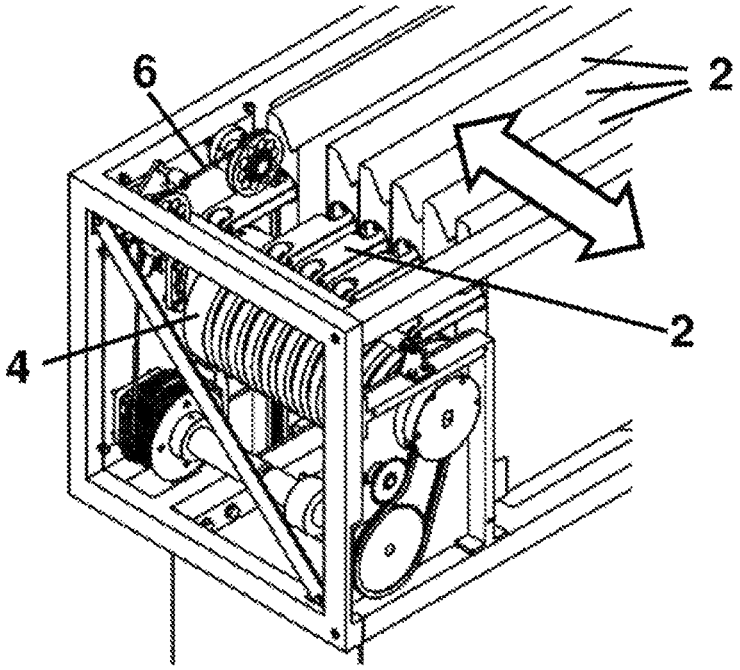
FIG. 7 shows a left part.
Figure 8:
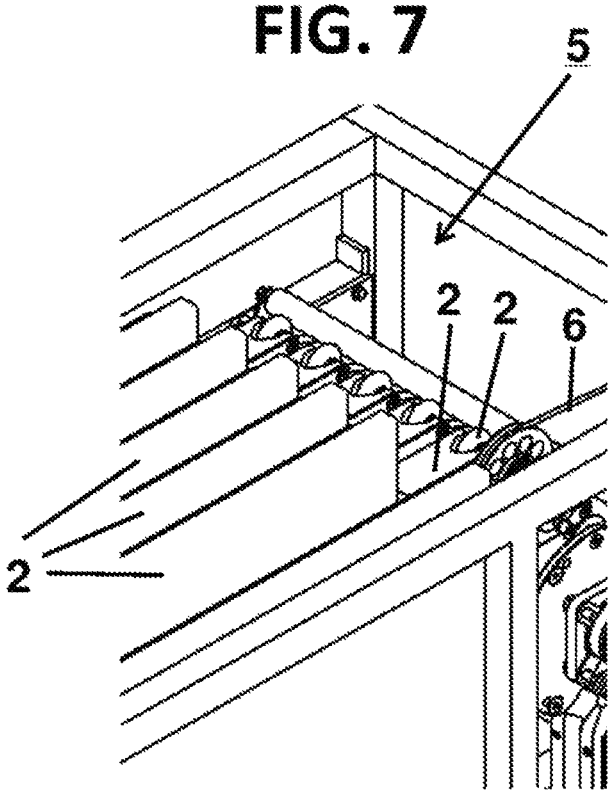
FIG. 8 shows a right part of the storage zone (or storage space) and the worm wheel of the sectional door of FIG. 3, albeit in the open state, as viewed from viewing direction A, respectively B.

FIG. 7 shows a left part, and FIG. 8 shows a right part of the storage zone 5 of the sectional door of FIG. 3 when it is in the open state. In this figure, the (optional) cover plates (or boards or the like) are removed for illustrative reasons. The figures show, inter alia, the cable 6, e.g. steel cable, which is connected to the bottom panel 21 for moving the bottom panel 21 in the height direction (by controlled pulling upwards or controlled lowering). When the bottom panel 2*a* is moving down, all panels stacked thereon are also moving down. The cable 6 can for instance be rolled up on a reel in known ways, and the reel can be driven by a motor in any known manner.

In the storage zone 5 of the sectional door 1 of FIG. 7, however, the panels 2 are not slid against each other in horizontal or inclined rails, as in the prior art, but they are suspended by their lateral extensions 23 (on both sides of the panel 2) on two worm wheels 4 (only one worm wheel is visible in FIG. 7). A rotation of the worm wheel 4 causes the panels 2 resting thereon to move in the direction of the arrow, e.g. in the horizontal direction, perpendicular to the plane of the upright profiles 3.

FIG. 8 shows a right part of the storage zone 5, and includes a second worm wheel 4 of the sectional door (not visible, but it is located beneath the extension 23). Obviously, the two worm wheels 4*a*, 4*b* need to rotate substantially at the same speed. The lateral extensions 23 preferably have a wheel 24 in order to minimize the friction with the worm wheel, and to promote a smooth movement.

Furthermore, the speed of pulling up (resp. lowering) the cable 6 needs to be matched to the speed of the rotation of the worm wheels 4, as will be explained further. Such synchronization can for instance be realized by means of one electric motor and appropriate mechanical transmissions, e.g. gears, belt drives, or chain drives, or by means of several electric motors, and an appropriate electrical control. The electrical control may be further provided with sensors for detecting a raised water level, and for automatically closing the sectional door in response thereto. Mechanical or electrical synchronization of movements are well known to the skilled person, and therefore need not be further described here. For completeness, it is noted that in principle also other than electric motors are possible, e.g. a pneumatic motor.

Besides a motor, preferably the sectional door 1 also contains means for manual operation, e.g. a crank (not shown), or emergency batteries so that the sectional door can also be opened or closed manually, in case of electrical power failure, as is often the case during a flood. The whole mechanism may be operated with one or two cranks, and with a moderate force torque, which can be realized in known manners, e.g. by means of toothed wheels, worm wheels, and the like.

Above it was already explained that the panels can perform a vertical movement (between the upright rails 3), and once they are on the worm wheel, they can perform a horizontal movement. Referring to FIG. 9 to FIG. 12 it will be explained how the upper panel of the stack is lifted, and brought on top of the worm wheel 4, and moved into the storage zone 5. To this end, the worm wheel 4 has a gripper arm 41, e.g. in the form of a cylindrical wall section, but the invention is not limited thereto, and other forms are also possible. The gripping arm can be regarded as a first segment 41 of the worm wheel, and is preferably unitarily formed with the second, cylindrical segment of the worm wheel 4. In other words, preferably the worm wheel 4 has a first section 41 and a second section 42, which preferably are manufactured from one and the same part, e.g. by casting. Alternatively, this worm wheel may also comprise or consist of two or more pieces which are joined.

The gripper arm 41 shown in the present example has a cross-section (in a plane perpendicular to the axis of the worm wheel 4) with a circular segment of 150° to 210°, e.g. about 180°. Due to the above mentioned synchronization between the worm wheels 4 and the cable 6, the panel that is located at the top of the stack at a specific moment in time, will be, with its lateral extensions 23 (only one of which is visible in FIG. 9) in a position higher than a lower end of the gripper arm, as shown in FIG. 9, where preferably a wheel 45 or the like is mounted.

FIG. 9 shows how the gripper arm 41 of the worm wheel 4 comes into contact with the extension 23 of the highest panel on the stack. During a further rotation of the worm wheel 4 in the direction of the arrow (and at the same time a small upward displacement due to the cable 6 being pulled up), the gripper arm will engage and carry along the extension 23, so that the top panel is removed from the stack, while the bottom panel 21, and the panels resting thereon are pulled upwards, e.g. at a constant speed. The panel 2 is thus gripped by the gripper arm 41 of the worm wheel 4, and is accelerated in the vertical direction indicated by the arrow. Since the gripper arm 41 performs a rotational movement, the upward velocity of the panel varies sinusoidally, with a minimum speed in the position of FIG. 9, with a maximum speed in the position of FIG. 10, and again a minimum speed in the position of FIG. 11. In this way, the panel 2 can be gripped "gently" (at minimum speed), then is accelerated maximally in order to rapidly remove it from the underlying panel (e.g. to click release the releasable connection), and then is slowed down again to "gently" arrive on top of the worm wheel 4, and then to move into the storage zone (FIG. 11 and FIG. 12).

It is noted that the movement of the panel is purely vertical, as long as the panel is resting on an inner surface of the first segment 41. This has the advantage that no special requirements are imposed on the releasable coupling means of the panels, such as e.g. bevels, additional clearance, and the like, making it easier to provide a watertight connection between the panels, if so desired. After the vertical movement, more in particular when the wheel 24 of the lateral extension 23 has landed on the outer periphery of the cylindrical section of the gripping arm 41 (see FIG. 11), the panel performs a pure horizontal movement, as long as the panel rests on the outer periphery of the first segment 41 and on the second segment 42.

It is noted that the worm wheel 4 in the example shown has a constant outer diameter, but that is not essential to the present invention, although it is preferred, because such a worm wheel is simpler to produce and to dimension. If the outer diameter is not constant, then it is preferably the greatest in the region of the first segment 41. This can e.g. be advantageous in countries where frequently earthquakes occur, in order to prevent the panels that are arranged on the worm wheels to unwantedly end up between the upright rails 3.

It is further noted that the gripping arm 41 preferably has a wheel 45 or the like for causing minimal friction between the gripping arm 41 and the lateral extension 23 during positions ranging from the position shown in FIG. 9 to the position shown in FIG. 11. Thereafter (FIG. 11), the wheel 24 of the lateral extension 23 runs in a helical groove which is located on the outside of the cylindrical wall section 41, and which extends further to the second segment 42.

FIG. 10 thus shows how the panel is lifted in an accelerated manner, i.e. that it moves upwards at a velocity (due to the gripping arm 41) which is greater than that of the underlying panel (due to the cable 6 being pulled upwards), so that the releasable connection (e.g. the lip-groove connection or snap connection) between these panels is disengaged.

FIG. 11 shows the end of the accelerated upward movement of the upper panel 2, and the start of the horizontal movement in the storage zone 5. Whereas in the prior art, horizontal or inclined rails are used, in which the panels are pressed laterally against each other, in the present invention the panels are arranged next to each other without touching each other, by making use of a worm wheel with a helical groove 44 and a suitable choice of the pitch "s", in function of the thickness "d" of the panel 2.

FIG. 12 shows the position which the panel of FIG. 11 will occupy after several revolutions of the worm wheel 4. The worm wheel is shown here with only one panel for illustrative reasons, but, in practice, it is of course intended that upon each rotation of the worm wheel 4 each time one additional (the uppermost) panel of the partial stack is removed, and is added to the second segment 42 for storage in the storage zone 5. The skilled person can easily achieve this by choosing a suitable speed ratio of the cable 6 with which the bottom panel 21 is pulled upwards, and the rotational speed and the diameter of the worm wheel 4. In the worm wheel 4 of FIG. 12 the helical groove 44 of the worm wheel has a larger pitch "s" in the area of the first segment 41, then over the rest of the worm wheel. In this way, the distance between the panels 2 in the storage zone 5 can e.g. be kept small (compact storage), while the distance between the panel that is being accelerated (in the plane of the upright rails 3) remains sufficiently large, so as to to minimize the risk of damage due to potential swinging of the panel as a result of the acceleration. Optionally, also push rubbers can be arranged on the panels in order to avoid damage or scratches due to collisions.

Although the function of the worm wheel 4 has been described above when the sectional door 1 is being opened, the skilled person will understand that the reverse reasoning applies when the sectional door 1 is being closed. More specifically, the worm wheels 4 are then rotated in the reverse direction, so that the panels can move from the second segment 42 towards the first segment 41 (in FIG. 12), and that the panel that is located closest to the first segment 41, is shifted in the groove of the cylindrical wall section (see FIG. 11), and that this panel 2 will then be carried by the wheel 45 which supports the lateral extension 23 (see FIG. 10), and that the panel is then accelerated downwardly and slowed down again, until it is gently lowered onto the subjacent panel (see FIG. 9). At the same time, the entire stack of panels (present between the upright rails) and resting on the bottom panel 21 moves downwards, as the bottom panel 21 is lowered by the cable 6.

Although not explicitly shown, the invention also relates to a worm wheel as described above, as well as to a kit of parts, comprising a worm wheel 4 as described above, and at least two panels 2 as described above, wherein each panel has a lateral extension 23 with a wheel 24 that fits into the helical groove of the worm wheel 4, and wherein the pitch (s1) of the helical groove about the entire worm wheel 4 is larger than the thickness d of the panels 2, so that the risk of scratches due to panels laterally touching each other, is greatly reduced.

FIG. 13 shows the panels when the sectional door is in its stored state (open state). It can further be seen in FIG. 13 that the cylindrical wall section 41 and the worm wheel 42 are connected to each other in such a way that the helical groove has a continuous transition between the cylindrical wall section and the worm wheel.

In a further aspect, the present invention also relates to a sectional door, characterized in that it is watertight in the closed state and that it is composed of a plurality of panels having a shape such that they can be stacked on top of each other in a stacked state of the sectional door, and next to each other in a stored state of the sectional door. The panels are loose panels that can be stacked on top of each other in the stacked state (i.e. door closed), or be hung next to each other in the stored state (i.e. door open). The panels of the sectional door in accordance with this aspect are not permanently connected to each other. This has the advantage compared to systems with, for example hinged connections between adjacent panels, that the panels do not need to be "rolled up", but can be stored separately, e.g. next to one another. In this way the storage is compact. Moreover, in this way it is also avoided that connection elements have to be used which are typically subject to wear (for example, can rust when used in a humid environment), and which usually also prevent that the panels can be arranged in a compact stack. Other features of the sectional door may be such as those described for sectional doors according to the first aspect, although sectional doors according to the present aspect are not limited thereby. The drive mechanism and/or lifting mechanism can for example be a conventional mechanism. Watertightness of the doors is obtained by providing sealing elements between the panels on the one hand, and between the panels and the side rails on the other hand. The seals between the panels and underneath the bottom panel may for instance be provided by means of a solid rubber. The seals of the door with the fixed side profiles may for example be accomplished by means of an inflatable seal. The seals could also be provided all around, including the storage zone, so that the complete door is watertight.

In yet a further aspect, the present invention relates to a sectional door in which the storage of the panels is achieved by arranging them on a worm wheel. More specifically, the sectional door comprises a plurality of panels having a shape such that they can be stacked on top of each other in a stacked state of the sectional door, and next to each other in a stored state of the sectional door. It also includes a drive system with a cable or a chain attached to the bottom panel, adapted for moving the bottom panel and the panels resting thereon in the height direction. It also comprises upright rails for guiding the stacked panels, and means for guiding the panels in a storage zone. In the present aspect, the latter means is a worm wheel. Furthermore, the worm wheel is designed so that, in the stored state of the sectional door, lateral extensions of the panels rest in the grooves of the worm wheel. The worm wheel thus supports the panels when they are in the stored position. As a result, the panels can be stored in a compact and non-touching manner. In addition, the storage can also be accomplished in a silent way, as compared to a system in which the panels are slid onto support rails. Further features of the sectional door may be as described in the other aspects described above. In addition, features of the present aspect can also be implemented in embodiments of the other aspects described above.

REFERENCES

1 sectional port
2 panels
21 bottom panel
23 lateral extension
24 wheel
25 protrusion
26 recess
3 upright rails
4 worm wheel
41 first segment
42 second segment
44 helical groove of the second segment
45 wheel of the gripper arm
5 storage zone
6 cable or chain
7 floor profile
s pitch of the groove
d thickness of the panels
H height of the panels
L length of the panels

The invention claimed is:

1. Sectional door comprising:

a plurality of panels having a shape such that the plurality of panels are vertically stacked on top of each other in a closed state of the sectional door, and are horizontally stacked next to each other in a stored state of the sectional door;

a drive system with a cable or a chain attached to a bottom panel, the drive system moving the bottom panel and the panels resting thereon in the height direction;

upright rails guiding the panels stacked on top of each other;

means for guiding the panels in a storage zone;

wherein the drive system further comprises a lifting mechanism removing a highest panel from a stack of panels by accelerating said highest panel, and subsequently transferring said highest panel to the means for guiding the panels in the storage zone, wherein the means for guiding the panels in the storage zone comprise a worm wheel having a helical groove guiding the panels in the storage zone, by supporting a lateral extension of the panels in the helical groove.

2. The sectional door according to claim 1, wherein the lifting mechanism comprises a gripper arm for gripping a lateral extension of the highest panel, and further comprises a helical groove for moving the highest panel to the storage zone.

3. The sectional door according to claim 2, wherein the lateral extension of the panels further comprise a wheel that fits into the helical groove.

4. The sectional door according to claim 3, wherein the gripper arm comprises a cylindrical wall section adapted to perform a rotational movement and wherein the helical groove is arranged on an outside of the cylindrical wall section, wherein the cylindrical wall section and the worm wheel are connected to each other in such a way that the helical groove has a continuous transition between the cylindrical wall section and the worm wheel.

5. The sectional door according to claim 3, wherein the helical groove of the worm wheel has a larger pitch in the region of the cylindrical wall section than over the remainder of the worm wheel.

6. The sectional door according to claim 1, wherein the gripper arm comprises a cylindrical wall section adapted to perform a rotational movement;

and wherein the helical groove is arranged on an outside of the cylindrical wall section.

7. The sectional door according to claim 6, wherein the cylindrical wall section comprises a wheel, adapted to support the lateral extension in a displaceable manner.

8. The sectional door according to claim 1, wherein the worm wheel is provided such that the lateral extensions of the panels are supported in the helical groove, when the panels are stored in the storage zone.

9. The sectional door according to claim 1, wherein a lower panel has at an upper side a protrusion, and an upper panel has at a bottom side a recess of a complementary shape, or vice versa.

10. The sectional door according to claim 1, further comprising inflatable rubber seals arranged in the upright rails for watertight sealing of the sectional door in the closed state.

11. The sectional door according to claim 1, wherein the panels comprise a profile of extruded aluminum, or of fiber-reinforced plastic, or of machined plastic, or of extruded aluminum and fiber-reinforced plastic, or of extruded aluminum and machined plastic, or of fiber-reinforced plastic and machined plastic, or of extruded aluminum and fiber-reinforced plastic and machined plastic.

* * * * *